US008485701B2

(12) United States Patent
Chiu

(10) Patent No.: US 8,485,701 B2
(45) Date of Patent: Jul. 16, 2013

(54) EMBEDDED LAMP AND REPLACEABLE ILLUMINATION MODULE FOR THE SAME

(75) Inventor: Hua-Jung Chiu, Jhongli (TW)

(73) Assignee: DaVinci Industrial Inc., New Taipei (TW)

( * ) Notice: Subject to any disclaimer, the term of this patent is extended or adjusted under 35 U.S.C. 154(b) by 553 days.

(21) Appl. No.: 12/836,008

(22) Filed: Jul. 14, 2010

(65) Prior Publication Data

US 2012/0014121 A1 Jan. 19, 2012

(51) Int. Cl.
*F21V 21/24* (2006.01)
*F21S 8/08* (2006.01)

(52) U.S. Cl.
USPC ..... 362/418; 362/430; 362/257; 362/801

(58) Field of Classification Search
None
See application file for complete search history.

(56) References Cited

U.S. PATENT DOCUMENTS

2012/0155087 A1* 6/2012 Kim et al. ..... 362/249.03

* cited by examiner

*Primary Examiner* — Ashok Patel
(74) *Attorney, Agent, or Firm* — Houtteman Law LLC

(57) ABSTRACT

An embedded lamp and a replaceable illumination module are disclosed. The embedded lamp includes a lamp cover having a hollow housing, and a top frame fixed on the hollow housing. The replaceable illumination module is received in the hollow housing, and includes a connection base for connecting a lamp set, a middle sleeve received in the connection base, a rotation sleeve received in the middle sleeve and protruding outside the middle sleeve, a stop ring fastened at the top side of the middle sleeve, a rotation locking flake fastened at the top side of the rotation sleeve, and a elastic element for pushing the rotation sleeve. When the replaceable illumination module is pushed, the rotation sleeve is rotated in the middle sleeve and fixed at different locations. The rotation locking flake and an opening of the top frame are unlocked when both are parallel or locked when both are vertical.

10 Claims, 6 Drawing Sheets

EMBEDDED LAMP AND REPLACEABLE ILLUMINATION MODULE FOR THE SAME

BACKGROUND OF THE INVENTION

1. Field of the Invention

The present invention relates to an embedded lamp and a replaceable illumination module for the embedded lamp; in particular, to an embedded lamp that receives a replaceable light module for the embedded lamp in the lamp mask. The illumination module of the embedded lamp can be changed with different illumination modules.

2. Description of Related Art

Embedded lamps are widely used as indoor illuminating devices. For reducing power consumption, the embedded lamp does not use the hot light bulb as the light source again. The power-saving light source is adopted.

However, the embedded lamp cannot be changed with different light modules, such as power-saving bulbs, LED lamps, or PL-C lamp. When different module is used, the embedded lamp must be totally changed. It is consumed and is not good for environment.

SUMMARY OF THE INVENTION

The object of the present invention is to provide an embedded lamp and a replaceable illumination module for the embedded lamp. The embedded lamp can be changed with different illumination modules. When a different illumination module is used, the embedded lamp does not need to be totally changed. The environment protection is achieved.

In order to achieve the aforementioned objects, according to an embodiment of the present invention, a replaceable illumination module for an embedded lamp is provided. The replaceable illumination module is installed in a lamp cover of the embedded lamp and can be disassembled. The replaceable illumination module includes a connection base, a middle sleeve, a rotation sleeve, a stop ring, a rotation locking flake, and a elastic element. The connection base includes a bottom board for connecting a lamp set, and a ring-shaped wall protruding upwards from the bottom board. The inner side of the ring-shaped wall has a plurality of concave slots and a plurality of slanted guiding surfaces located between the concave slots. The middle sleeve is received in the ring-shaped wall, and includes a plurality of guiding blocks protruding outwards from the external ring surface and received in the concave slots. The rotation sleeve is received in the middle sleeve and exposed outside of the top surface of the middle sleeve, and includes a plurality of sliding blocks extending outwards from the bottom and slidingly connecting the guiding blocks of the middle sleeve. The stop ring is fastened at the top side of the middle sleeve. The rotation locking flake is located above the stop ring, and is fastened at the top side of the rotation sleeve. The elastic element pushes rotation sleeve upwards.

In order to achieve the aforementioned objects, according to an embodiment of the present invention, an embedded lamp is provided. The embedded lamp includes a lamp cover, and a replaceable illumination module for an embedded lamp. The lamp cover includes a hollow housing, and a top frame located above the hollow housing. The top frame is fastened at two sides of the hollow housing. The replaceable illumination module for an embedded lamp is received in the hollow housing, and includes a connection base, a middle sleeve, a rotation sleeve, a stop ring, a rotation locking flake, and a elastic element. The connection base includes a bottom board for connecting a lamp set, and a ring-shaped wall protruding upwards from the bottom board. The inner side of the ring-shaped wall has a plurality of concave slots and a plurality of slanted guiding surfaces located between the concave slots. The middle sleeve is received in the ring-shaped wall, and includes a plurality of guiding blocks protruding outwards from the external ring surface and received in the concave slots. The rotation sleeve is received in the middle sleeve and exposed outside of the top surface of the middle sleeve, and includes a plurality of sliding blocks extending outwards from the bottom and slidingly connecting the guiding blocks of the middle sleeve. The stop ring is fastened at the top side of the middle sleeve. The rotation locking flake is located above the stop ring, and is fastened at the top side of the rotation sleeve. The elastic element pushes rotation sleeve upwards.

The present invention has the following characteristics. The embedded lamp can be changed with different kinds of illumination modules, and the original lamp cover of the embedded lamp can re reserved. The resource is not wasted and the environment protection is achieved. Furthermore, the user can replace different kinds of light sources and does not need to change the total set of embedded lamp.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1:
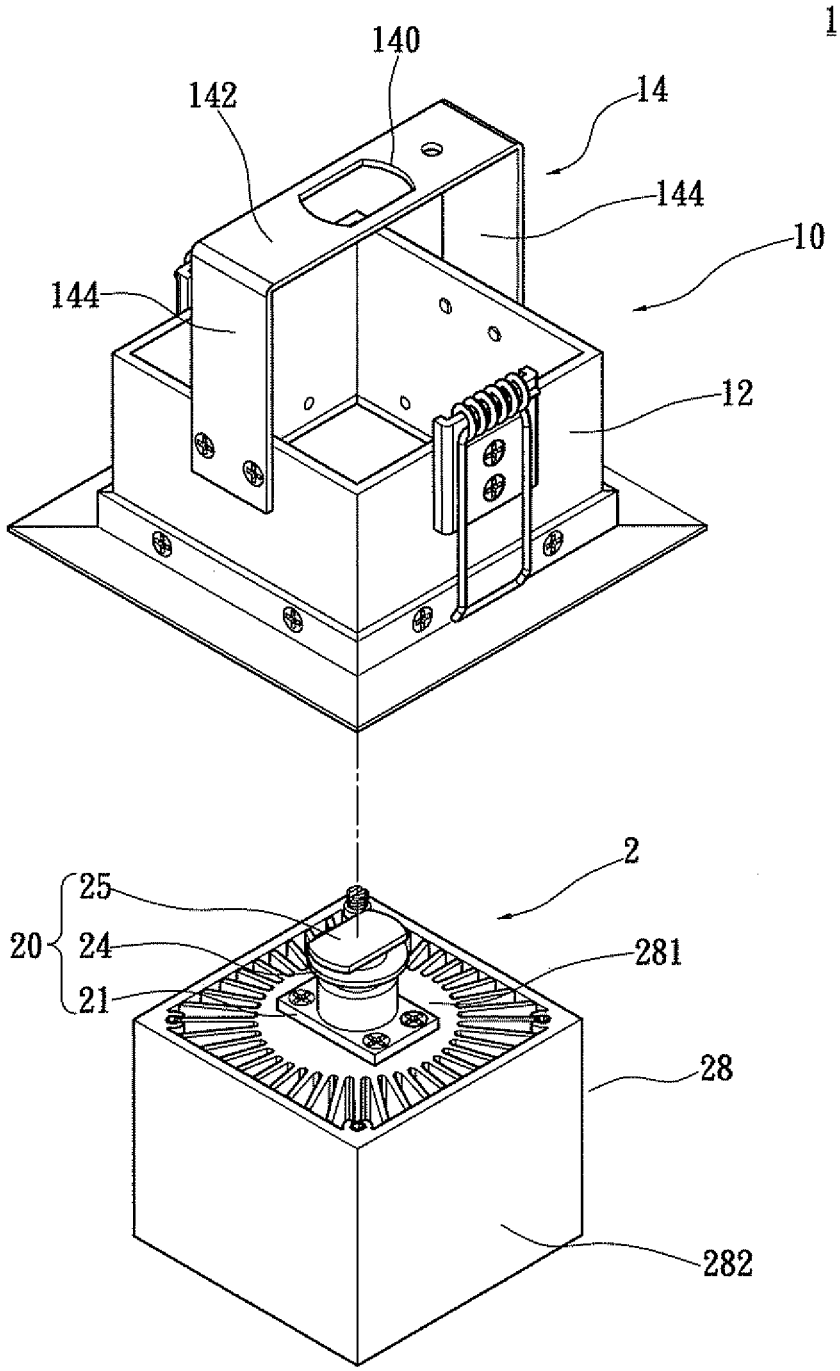
FIG. 1 shows an exploded perspective diagram of part of an embedded lamp according to an embodiment of the present invention.

Reference is made to FIG. 1, which shows the exploded perspective diagram of part of the embedded lamp the present invention. The embedded lamp 1 includes a lamp cover 10, and a replaceable illumination module 2 for an embedded lamp. The lamp cover 10 includes a hollow housing 12, and a top frame 14 located above the hollow housing 12. The top frame 14 is fastened at two sides of the hollow housing 12. The replaceable illumination module 2 for an embedded lamp is received in the hollow housing 12, and can be disassembled. The top frame 14 includes a top board 142 and a pair of side boards 144 fastened at two sides of the hollow housing 12. The top board 142 has a rectangular opening 140.

The replaceable illumination module 2 for an embedded lamp is installed in the lamp cover 10 and can be disassembled. When the user changes the light source, such as LED lamp with different temperature color, the user does not need to change the total set of embedded lamp. The user only needs to change the replaceable illumination module 2 for an embedded lamp.

Figure 2:
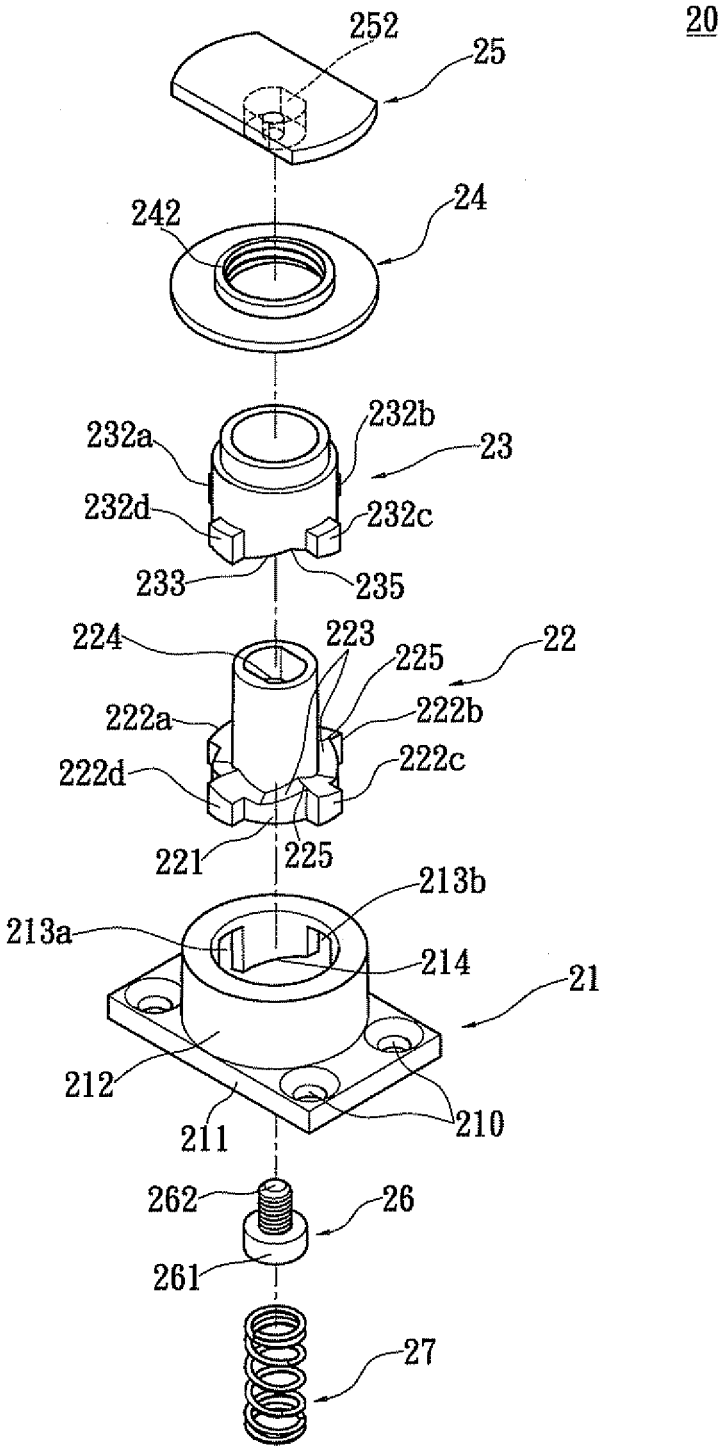
FIG. 2 shows an exploded perspective diagram of a locking mechanism of the replaceable illumination module of according to an embodiment of the present invention.

Reference is made to FIG. 2, which shows the exploded perspective diagram of a locking mechanism of the replaceable illumination module of according to an embodiment of the present invention. The top of the replaceable illumination module 2 for an embedded lamp has a locking mechanism 20. The locking mechanism 20 has a connection base 21, a middle sleeve 20 received in the connection base 21, a rotation sleeve 22 received in the middle sleeve 23, a stop ring 24 fastened at the top of the middle sleeve 23, a rotation locking flake 25 located above the stop ring 24 and fastened at the top of the rotation sleeve 22, and a elastic element 27 pushing the rotation sleeve 22 upwards.

The connection base 21 includes a bottom board 211 for connecting a lamp set 28 (as shown in FIG. 1), and a ring-shaped wall 212 protruding upwards from the bottom board 211. The inner side of the ring-shaped wall 212 has a plurality of concave slots 213*a*, 213*b*, and a plurality of slanted guiding surfaces 214 located between the concave slots 213. In one preferred embodiment, the quantity of the concave slots is 4 (two concave slots are not shown in the figure), and are disposed at the inner side of the ring-shaped wall 212 with an angle 90 degrees.

In this embodiment, the bottom board 211 of the connection base 21 has a plurality of screw holes 210. The bottom board 211 is locked with the lamp set 28 via screws (as shown in FIG. 1). The lamp set 28 is an LED lamp set, and has a cooling fin 281 and an external mask 282 wrapped the side surface and part of the bottom surface. However, the connection base 21 can be a E27 lamp base, or a PL-C lamp base.

The middle sleeve 23 is received in the ring-shaped wall 212 of the connection base 21. The middle sleeve 23 has a plurality of guiding blocks protruding outwards from the external ring surface and received in the concave slots 213*a*, 213*b*. In this embodiment, the quantity of the guiding blocks is four and the guiding blocks 232*a*, 232*b*, 232*c*, 232*d* are disposed with the identical angle.

The rotation sleeve 22 is received in the middle sleeve 23 and exposes outside of the top surface of the middle sleeve, and includes a convex plate 221 protruding outwards from the external ring surface and a plurality of sliding blocks extending outwards from the bottom. In this embodiment, the quantity of the sliding blocks 222*a*, 222*b*, 222*c*, 222*d* is four and the sliding blocks are slidingly connected with the guiding blocks 232*a*, 232*b*, 232*c*, 232*d* of the middle sleeve 23. The outer diameter of the convex plate 221 is the same as the outer diameter of the middle sleeve 23. The convex plate 221 contacts and connects the bottom edge of the middle sleeve 23.

In this embodiment, the convex plate 221 of the rotation sleeve 22 has a plurality of slant surfaces 223 and a plurality convex portions 225 located between the slant surfaces 223. The bottom edge of the middle sleeve 23 has a plurality of slant surfaces 233 and a plurality of concave portions 235. The outline of the bottom edge of the middle sleeve 23 corresponds to the outline of the convex plate 221. The location of the concave portions 235 and the location of the convex portions have a pre-determined angle. In this embodiment, the angle is 15 degrees.

The stop ring 24 is fastened at the top side of the middle sleeve 23. In this embodiment, the stop ring 24 has a screw-locking portion 242 to be screwed at the top side of the middle sleeve 23. The rotation locking flake 25 is located above the stop ring 24, and is fastened at the top side of the rotation sleeve 22. In this embodiment, the rotation locking flake 25 is connected with the rotation sleeve 22 via a connection screw 26. However, the connection way is not limited to above. For example, the bottom of the rotation locking flake 25 is wedged with the rotation sleeve 22 by a tight-fitness way. There is a distance between the stop ring 24 and the rotation locking flake 25 for receiving the top frame 14 of the lamp cover 10. The shape of the rotation locking flake 25 corresponds to the opening 140 of the top board 142.

The elastic element 27 pushes upwards to the rotation sleeve 22. In this embodiment, the elastic element 27 is a spring. The elastic element 27 is located in the rotation sleeve 22. The elastic element 27 has a top side for contacting the connection screw 26, and a bottom side for contacting the top surface of the lamp set 28. In this embodiment, the bottom side of the elastic element 27 contacts the top surface of the cooling fin 281.

Figure 3:
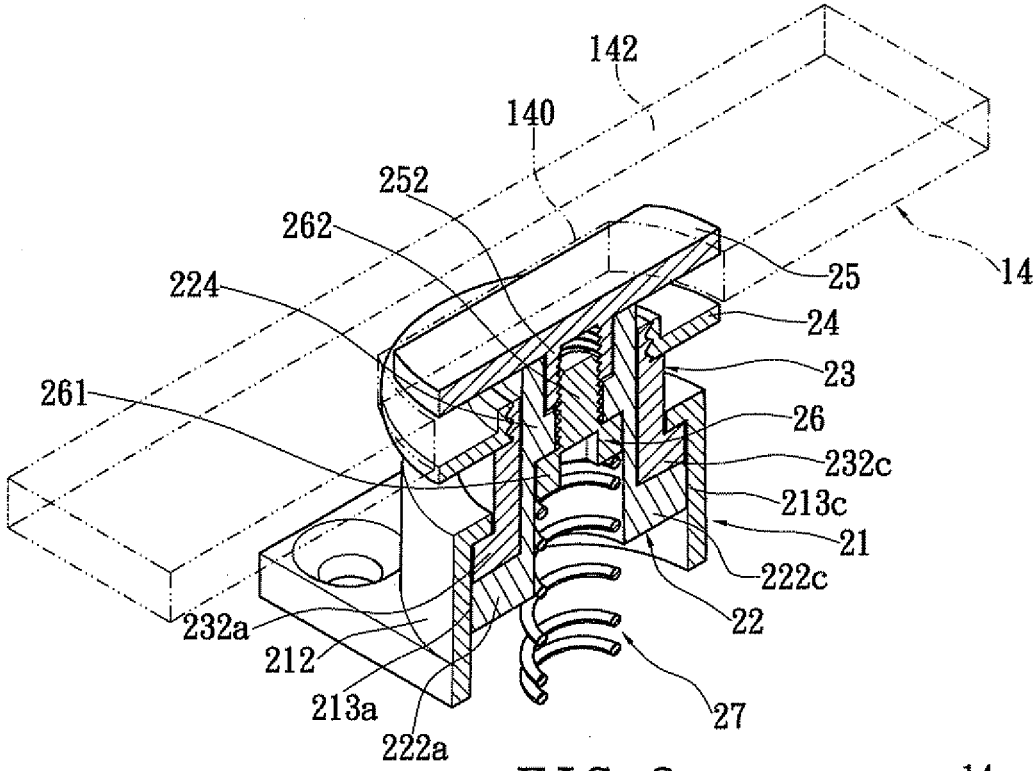
FIG. 3 shows an assembly cross-sectional diagram of a locking mechanism of the replaceable illumination module being in an unlock status of according to an embodiment of the present invention.

Reference is made to FIG. 3, which shows the assembly cross-sectional diagram of a locking mechanism of the replaceable illumination module of the present invention. In this embodiment, the way that the connection screw 26 fastens the rotation locking flake 25 with the rotation sleeve 22 is described as below. The rotation locking flake 25 has a screw-locking portion 252 that extends from the bottom of the rotation locking flake 25 into the rotation sleeve 22. The rotation sleeve 22 has a convex ring 224 that protrudes inwards from the inner wall surface to stop the screw-locking portion 252. The connection screw 26 has a head portion 261 for contacting the convex ring 224, and a rod portion 262 that passes through the convex ring 224 and is locked with the screw-locking portion 252. Thereby, the rotation locking flake 25 is fastened with the rotation sleeve 22.

Reference is made to FIGS. 1 and 3. The assembly way and disassembly way of the replaceable illumination module for an embedded lamp is described as below. First, the rotation locking flake 25 passes through the opening 140 of the top frame 14. Next, the replaceable illumination module for an embedded lamp is pushed upwards. In this embodiment, the user pushes the external mask 282 of the lamp set 28 from the bottom of the embedded lamp 1. At his times, the stop ring 24 is stopped by the top frame 14, and the connection base 21 moves upwards until the connection base 21 contacts the bottom surface of the top frame 14. The spring 27 is compressed.

Figure 4:
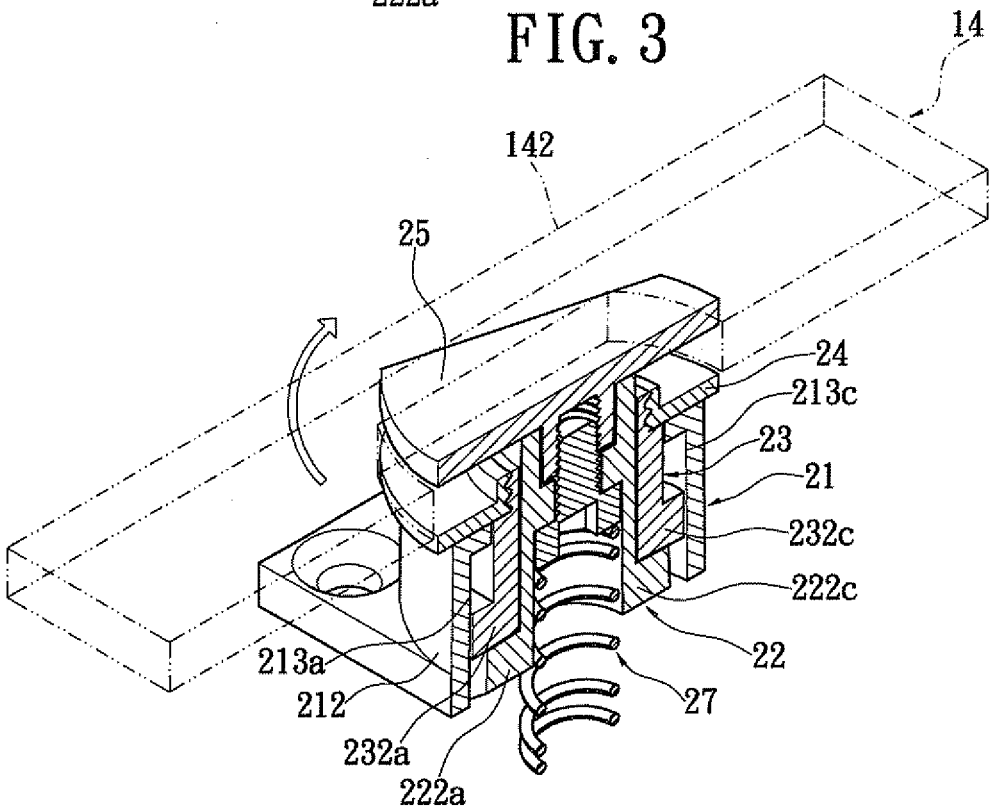
FIG. 4 shows an assembly cross-sectional diagram of a locking mechanism of the replaceable illumination module being locking of according to an embodiment of the present invention.

Reference is made to FIG. 4, which shows assembly cross-sectional diagram of a locking mechanism of the replaceable illumination module being locking of according to an embodiment of the present invention. When the connection base 21 moves upwards, the guiding blocks of the middle sleeve 23 and the sliding blocks of the rotation sleeve 22 moves downwards along the concave slots. As shown in the figure, the guiding blocks 232*a*, 232*c* and the sliding blocks 222*a*, 222*c*, move downwards. In this embodiment, the depth of the concave slot is smaller than the sum of the height of the guiding block and the height of the sliding block. Therefore, the guiding blocks 232*a*, 232*c* are still in the concave slots 213*a*, 213 *c*. The sliding blocks 222*a*, 222*c* are moved to outside of the concave slots 213*a*, 213 *c*.

Due to the slant surface of the bottom of the guiding blocks and the flexible force of the spring 27, the sliding blocks 222*a*, 222*c* slides along the slant guiding surface 214 of the connection base 21 (referring to FIG. 2) and are out of the concave slots 213*a*, 213*c*. When the sliding blocks 222*a*, 222*c* has an angle displacement to a pre-determined angle (in this embodiment, the angle is 15 degrees), two movements are generated. One is that the rotation locking flake 25 rotates with the same angle displacement. Another is that the convex portions 225 of the rotation sleeve 22 moves and is wedged into the concave portions 235 of the middle sleeve 23 (referring to FIG. 2). The convex plate 221 of the rotation sleeve 22 temporarily is wedged with the bottom edge of the middle sleeve 23.

Figure 5:
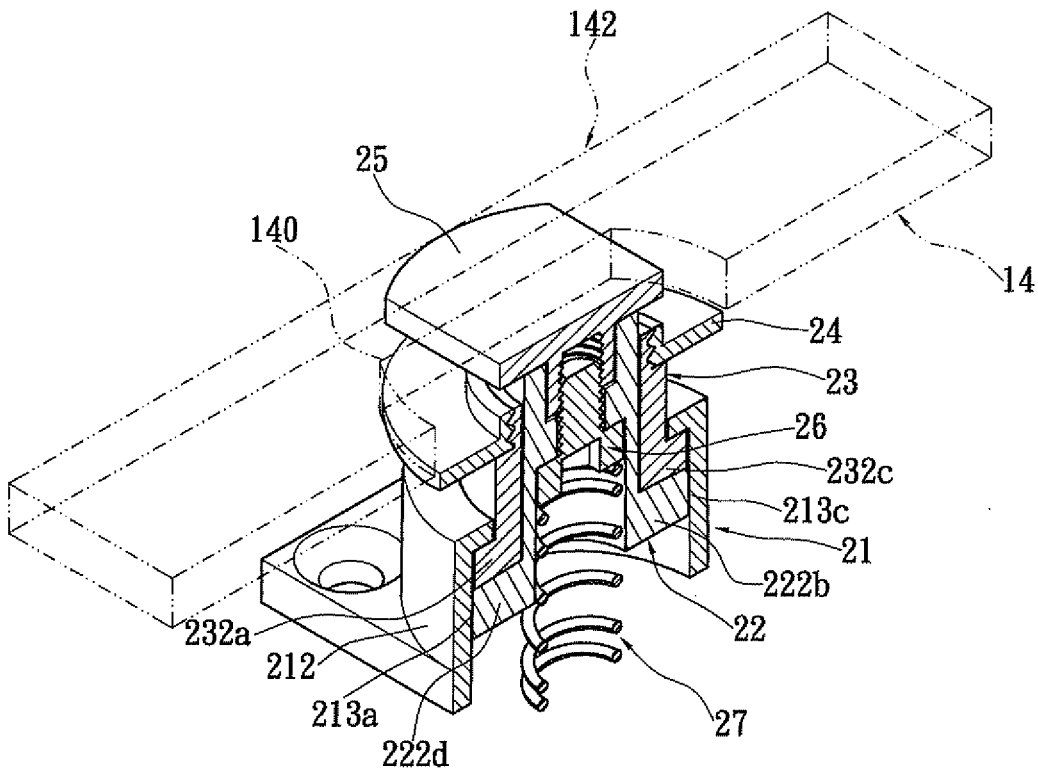
FIG. 5 shows an assembly cross-sectional diagram of a locking mechanism of the replaceable illumination module being in a lock status of according to an embodiment of the present invention.

Reference is made to FIG. 5, which shows the assembly cross-sectional diagram of a locking mechanism of the replaceable illumination module being in a lock status of according to an embodiment of the present invention. At this time, the hand of the user can leave the replaceable illumination module 2 for an embedded lamp. The connection base 21 moves downwards to the original location due to flexible force. The guiding blocks 232*a*, 232*c* moves to the top side of the concave slots 213*a*, 213*c*. The sliding blocks 222*a*, 222*c* slides along the slant guiding surface 214 of the connection base 21 until the sliding blocks 222*a*, 222*c* enters into next concave slots 213*b*, 213*d* (referring to FIGS. 2, and 214*d* is not shown). At this time, the rotation sleeve 22 and the rotation locking flake 25 continuously rotates (in this embodiment, along the clockwise direction). The sliding blocks 222*b*, 222*d* moves to the concave slots 213*a*, 213*c* and contacts the guiding blocks 232*a*, 232*c*.

Figure 6:
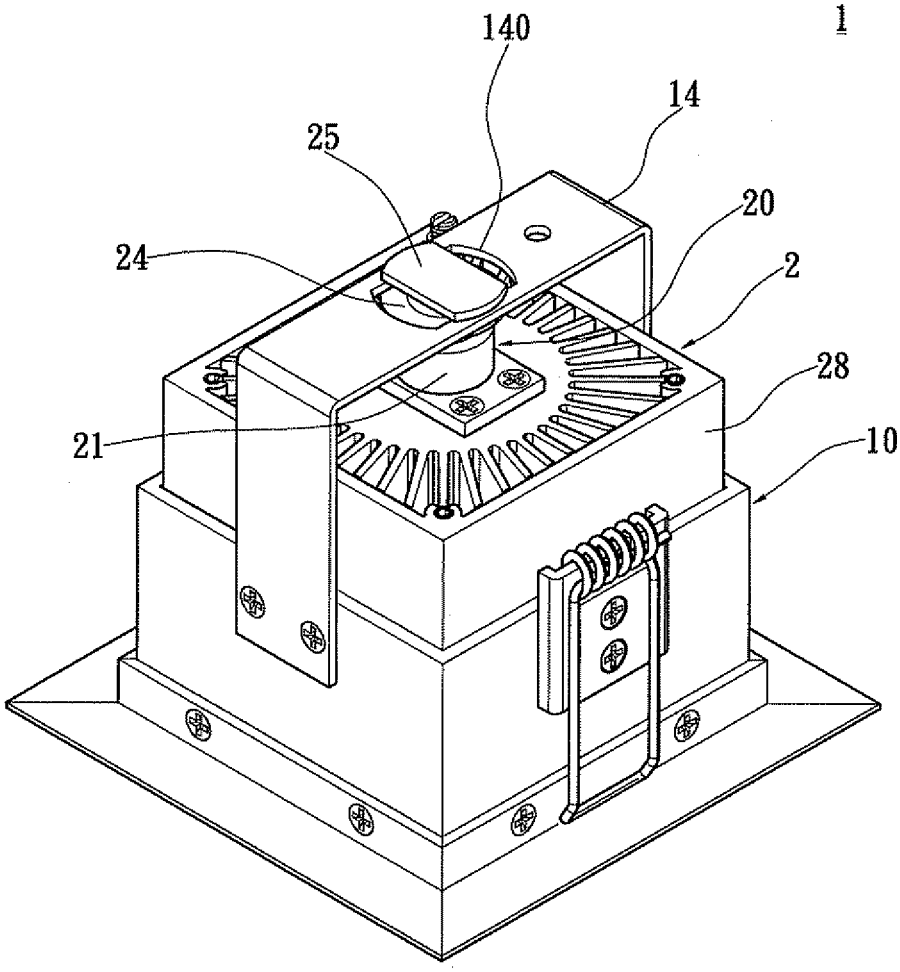
FIG. 6 shows an assembly perspective diagram of an embedded lamp according to an embodiment of the present invention.

Reference is made to FIG. 6, which shows the assembly perspective diagram of an embedded lamp. The rotation locking flake 25 and the top frame 14 are in a vertical status. The replaceable illumination module 2 is fastened in the lamp cover 10.

When the user changes the replaceable illumination module 2, the user pushes the replaceable illumination module 2 upwards. The sliding blocks of the rotation sleeve 22 leaves the concave slots again, and rotate along the clockwise direction. When the user feels that the convex plate 221 of the rotation sleeve 22 is temporarily wedged with the bottom edge of the middle sleeve 23, the force is reduced to make the connection base 21 recover to the original location. Next, the rotation sleeve 22 and the rotation locking flake 25 continuously rotate to the unlock location. In other words, the rotation locking flake 25 can leave the opening 140 of the top frame 14. Finally, the replaceable illumination module 2 moves downwards and leaves from the lamp cover 2.

Figure 7:
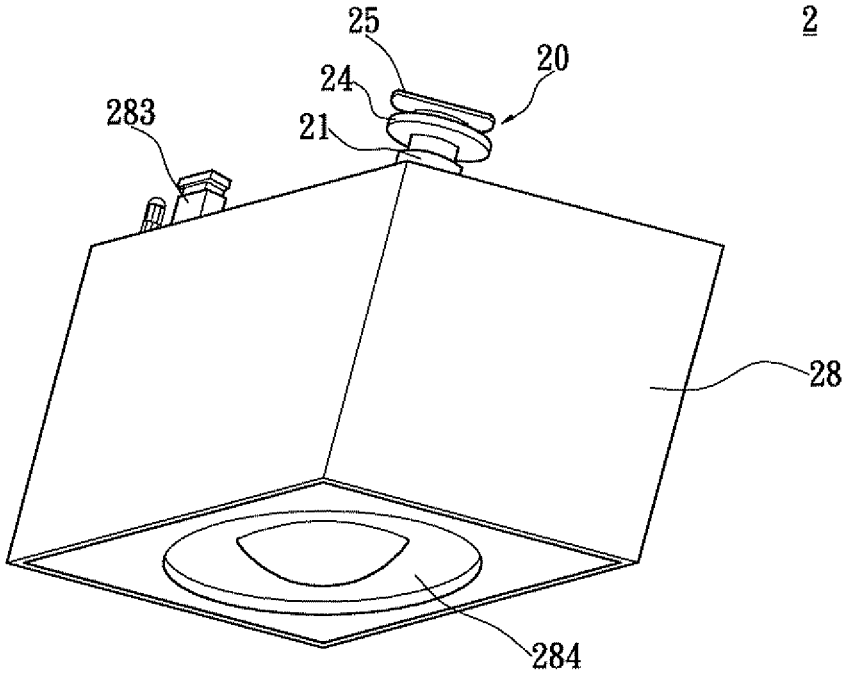
FIG. 7 shows a perspective diagram of the replaceable illumination module of according to a first embodiment of the present invention.
Figure 8:
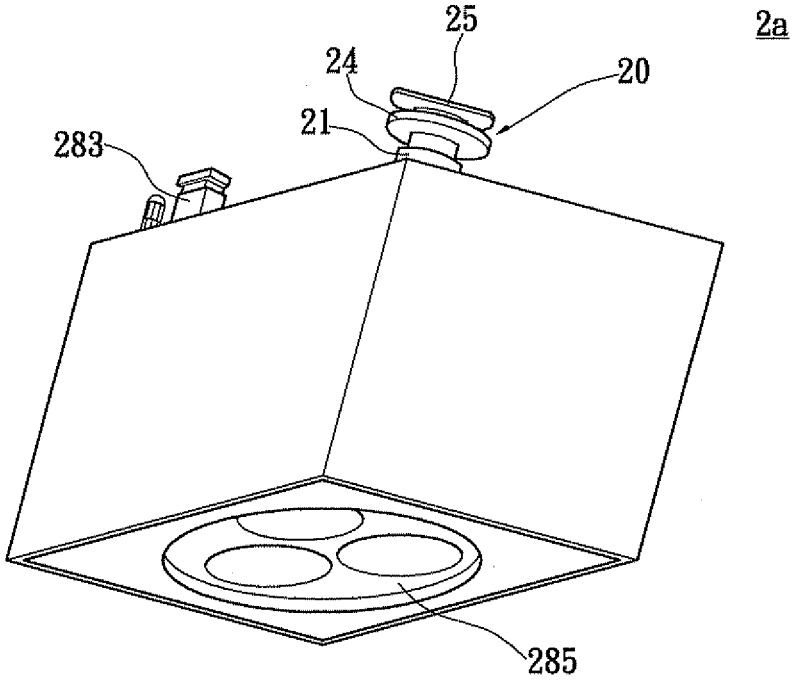
FIG. 8 shows a perspective diagram of the replaceable illumination module of according to a second embodiment of the present invention.

As shown in FIGS. 7 and 8. By utilizing the structure of the present invention, the lamp cover 10 for an embedded lamp can be assembled with different replaceable illumination modules 2, 2*a* for an embedded lamp. The replaceable illumination module 2 for an embedded lamp has a bulb 284. The replaceable illumination module 2*a* for an embedded lamp has three LED lamps 285. In this embodiment, the top surface of the replaceable illumination module 2 has a power supply connector 283 for connecting electrical wire.

The present invention provides replaceable illumination module 2 for an embedded lamp. Therefore, the user does not need to replace the lamp cover 10 and can be assembled with different light sources, such as power-saving bulb, LED, etc. The environment protection is achieved. Furthermore, the user can easily change the different illumination modules to meet the requirements, and does not need the change the total set of embedded lamp.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A replaceable illumination module for an embedded lamp, installed in an lamp cover, comprising:

a connection base having a bottom board for connecting a lamp set, and a ring-shaped wall protruding upwards from the bottom board, wherein the inner side of the ring-shaped wall has a plurality of concave slots and a plurality of slanted guiding surfaces located between the concave slot;

a middle sleeve received in the ring-shaped wall and having a plurality of guiding blocks protruding outwards from the external ring surface and received in the concave slots;

a rotation sleeve received in the middle sleeve and exposed outside of the top surface of the middle sleeve and having a plurality of sliding blocks extending outwards from the bottom and slidingly connecting the guiding blocks of the middle sleeve;

a stop ring fastened at the top side of the middle sleeve;

a rotation locking flake located above the stop ring, and is fastened at the top side of the rotation sleeve; and an elastic element pushing rotation sleeve upwards.

2. The replaceable illumination module for an embedded lamp according to claim 1, wherein the connection base has a plurality of screw holes, and the bottom board is screwed with the lamp set via screws.

3. The replaceable illumination module for an embedded lamp according to claim 1, wherein the quantity of the sliding concave slots, the guiding blocks and the sliding blocks are four.

4. The replaceable illumination module for an embedded lamp according to claim 1, further comprising a connection screw, wherein the rotation locking flake has a screw-locking portion extending downwards from the bottom into the rotation sleeve, the rotation sleeve has a convex ring protruding inwards from the inner wall surface and stopping the screw-locking portion, and the connection screw has a head portion for contacting the convex ring and a rod portion passing through the convex ring and being locked with the screw-locking portion;

thereby, the rotation locking flake is fastened with the rotation sleeve.

5. The replaceable illumination module for an embedded lamp according to claim 4, wherein the elastic element is located in the rotation sleeve, the elastic element has a top side for contacting the head of the connection screw and a bottom side for contacting the top surface of the lamp set.

6. The replaceable illumination module for an embedded lamp according to claim 1, wherein the rotation sleeve further comprises a convex plate that protrudes outwards from the external ring surface, the outer diameter of the convex plate is the same as the outer diameter of the middle sleeve, and the convex plate contacts the bottom edge of the middle sleeve.

7. The replaceable illumination module for an embedded lamp according to claim 6, wherein the convex plate of the rotation sleeve has a plurality of slant surfaces and a plurality of convex portions located between the slant surfaces, the bottom edge of the middle sleeve has a plurality of slant surfaces and a plurality of concave portions, the outline of the bottom edge corresponds to the outline of the convex plate, and there is a pre-determined angle between the location of the concave portions and the location of the convex portions.

8. The replaceable illumination module for an embedded lamp according to claim 1, wherein there is a distance between the stop ring and the rotation locking flake for receiving a top frame of the lamp cover.

9. An embedded lamp, comprising:

a lamp cover having a hollow housing and a top frame located above the hollow housing, wherein the top frame is fastened at two sides of the hollow housing;

a replaceable illumination module received in the hollow housing, comprising:

a connection base having a bottom board for connecting a lamp set, and a ring-shaped wall protruding upwards from the bottom board, wherein the inner side of the ring-shaped wall has a plurality of concave slots and a plurality of slanted guiding surfaces located between the concave slot;

a middle sleeve received in the ring-shaped wall and having a plurality of guiding blocks protruding outwards from the external ring surface and received in the concave slots;

a rotation sleeve received in the middle sleeve and exposed outside of the top surface of the middle sleeve and having a plurality of sliding blocks extending outwards from the bottom and slidingly connecting the guiding blocks of the middle sleeve;

a stop ring fastened at the top side of the middle sleeve;

a rotation locking flake located above the stop ring, and is fastened at the top side of the rotation sleeve; and a elastic element pushing rotation sleeve upwards.

10. The embedded lamp according to claim 9, wherein top frame has a top board and a pair of side board fastened at two sides of the hollow housing, and the top bard has a long opening that its shape corresponds to the shape of the rotation locking flake.

* * * * *